US009754563B1

(12) United States Patent
Chen

(10) Patent No.: US 9,754,563 B1
(45) Date of Patent: Sep. 5, 2017

(54) FORCE ADJUSTABLE SPRING-CLAMP CAPO

(71) Applicant: Aroma Music Co., Ltd., Shenzhen (CN)

(72) Inventor: Haihua Chen, Shenzhen (CN)

(73) Assignee: AROMA MUSIC CO., LTD., Shenzhen (CN)

( * ) Notice: Subject to any disclaimer, the term of this patent is extended or adjusted under 35 U.S.C. 154(b) by 0 days.

(21) Appl. No.: 15/455,247

(22) Filed: Mar. 10, 2017

(30) Foreign Application Priority Data

Dec. 21, 2016 (CN) ..... 2016 2 1408375 U

(51) Int. Cl.
*G10D 3/04* (2006.01)

(52) U.S. Cl.
CPC ..... *G10D 3/043* (2013.01)

(58) Field of Classification Search
CPC ..... G10D 3/08; G10D 3/043
See application file for complete search history.

(56) References Cited

U.S. PATENT DOCUMENTS 4,270,432 A * 6/1981 Wilkerson ..... G10D 3/043 84/318
6,008,441 A * 12/1999 Steinberger ..... G10D 3/043 84/318

* cited by examiner

*Primary Examiner* — Kimberly Lockett
(74) *Attorney, Agent, or Firm* — Anova Law Group, PLLC

(57) ABSTRACT

The present utility model discloses a force adjustable spring-clamp capo, comprises a string-engaging arm and a damping arm, the string-engaging arm and the clamping arm are hinged together by a composite pressing rivet, wherein a pressure adjustment mechanism is further arranged in a middle of the clamping arm, including: a pressure spring, a regulation screw and a regulation nut, by the pressure adjustment mechanism, a collapsing length of the pressure spring is adjusted, making the force of the spring change (Hooke's law), which makes the clamping force of the capo adjustable, it can also be operated by a single hand of a player as the spring-damp capo, thus owns a simple and easy operation, making a player be able to adjust to a best clamping force according to a requirement of the instrument thereof, to achieve a role of a tune transfer assistance perfectly. By a planar thrust bearing embedded in the regulation nut, the present utility model further reduces the resistance generated by the friction between the regulation nut and the clamping arm greatly, thus simplifies the operation of a force adjustment, and achieves the purpose of effort saving.

11 Claims, 6 Drawing Sheets

FORCE ADJUSTABLE SPRING-CLAMP CAPO

CROSS-REFERENCES TO RELATED APPLICATIONS

This application claims the priority of Chinese patent application no. 201621408375.2, filed on Dec. 21, 2016, the entire contents of all of which are incorporated herein by reference.

FIELD OF THE UTILITY MODEL

The present utility model relates to the field of a capo applied to a stringed instrument, and, more particularly, to a force adjustable spring-clamp capo.

BACKGROUND

A capo is a well-known assistance tool, used by a player of a stringed instrument to adjust a tone of the stringed instrument. The capo may be applied onto a plurality of stringed instruments, including a steel-string acoustic guitar, a classical guitar, an electric guitar, a banjo and more, which has a neck and a plurality of strings extending following a direction of the neck. The neck comprises a fingerboard portion next to the strings and a neck back next to the fingerboard. The fingerboard portion comprises slightly raised a plurality of frets on the fingerboard (that is, a front surface of the neck) and extending laterally. During using, the capo clamps the neck and keeps the strings leaning onto the fingerboard, especially onto one of the frets set following the direction of the fingerboard, to adjust a pitch generated by the strings through decreasing an effective length of the string.

Capos currently on market may be generally divided into a plurality of types including a toggle capo, a spring-clamp capo, a screw-on capo and a rolling capo.

The toggle capo (FIG. 1) is generally made by plastics, thus having a relatively worse quality, and easy to get broken.

The spring-clamp capo (FIG. 2) owns a design for easy and convenient use, and it may be operated by a single hand of the player, which owns a stable quality, and a constant flexibility. However, a clamping force of the capo may not be adjusted according to a different situation.

The screw-on capo (FIG. 3) is mainly made of a stainless steel material, the clamping force thereof may be adjusted through a spiral screw, to be loose or tight, however, it requires both hands of the player to operate an adjustment to reach a best usage state.

The rolling capo (FIG. 4) is also called a glider rolling capo. It has a character of being able to change a tune freely in a middle of playing, however, due to it is over flexible, an unstable performance may be leaded.

Therefore, the prior art needs to be improved and developed.

BRIEF SUMMARY OF THE DISCLOSURE

The technical problem to be solved in the present utility model, aiming at the defects of the prior art, provides a force adjustable spring-clamp capo, which may adjust the clamping force of the capo according to a requirement of the player, which is easy to operate, quick and effort saving.

In order to achieve the above listed targets, the technical solution of the present utility model is as follows:

A force adjustable spring-clamp capo, comprises a string-engaging arm and a clamping arm, the string-engaging arm and the clamping arm are hinged together by a composite pressing rivet, wherein a pressure adjustment mechanism is arranged in a middle of the clamping arm, including: a pressure spring, a regulation screw and a regulation nut, while the clamping arm further has a screw adjustment through hole, a nut accommodating port, applied to accommodating the regulation nut, and a screw limiting hole arranged; one end of the pressure spring locates in a spring accommodating hole in the string-engaging arm, another end of the pressure spring reaches one end of the regulation screw, another end of the regulation screw passes through the screw regulating through hole and screws with the regulation nut in the nut accommodating port, before inserting into the screw limiting hole.

The force adjustable spring-clamp capo, wherein a planar thrust bearing is embedded in the regulation nut, one end face of the planar thrust bearing touches the clamping arm.

The force adjustable spring-clamp capo, wherein the clamping arm comprises: a hinge portion, a pressure regulation portion and a handhold portion arranged sequentially; the hinge portion is a two-piece portion, the string-engaging arm is sandwiched between the two-piece portion, and hinged by the composite pressing rivet; the screw regulating through hole is arranged on the pressure regulation portion, the nut accommodating port is arranged between the pressure regulation portion and the handhold portion, the screw limiting hole is arranged on the handhold portion.

The force adjustable spring-clamp capo, wherein the hinge portion, the pressure regulation portion and the handhold portion are integrated into one piece.

The force adjustable spring-clamp capo, wherein the screw regulating through hole is T-shaped.

The force adjustable spring-clamp capo, wherein a middle portion of the string-engaging arm hinges with the hinge portion of the clamping arm.

The force adjustable spring-clamp capo, wherein an end face of the regulation screw has a raised portion, applied to preventing the pressure spring sliding.

The force adjustable spring-clamp capo, wherein a non-slip pattern is arranged on the regulation nut.

The force adjustable spring-clamp capo, wherein a first cushion is arranged on an inner surface of the string-engaging arm.

The force adjustable spring-clamp capo, wherein a second cushion is arranged on an inner surface of the clamping arm.

Comparing to the current arts, the force adjustable spring-clamp capo provided by the present utility model, owns an advantage of a simple operation and a stable flexibility as a spring-clamp capo, together with a character of force adjustable as a screw-on capo. By the pressure adjustment mechanism in the assembly structure, a collapsing length of the pressure spring is adjusted, making the force of the spring change (Hooke's law), which makes the clamping force of the capo adjustable, while similar to the spring-clamp capo, it can also be operated by a single hand of the player, thus owns a simple and easy operation, making the player be able to adjust to a best clamping force according to a requirement of the instrument thereof, thus achieving a role of a tune transfer assistance perfectly.

DETAILED DESCRIPTION

Figure 1:
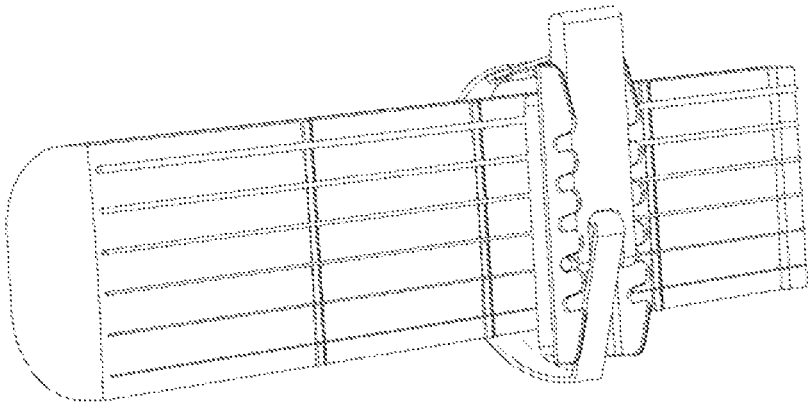
FIG. 1 illustrates a schematic diagram on a toggle capo in the present art.
Figure 2:
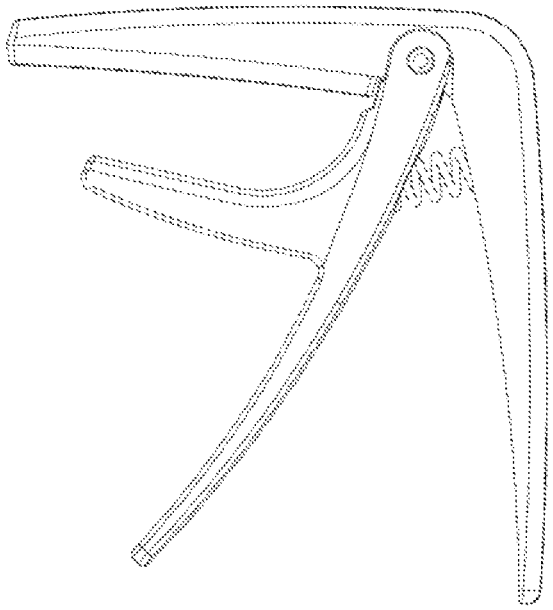
FIG. 2 illustrates a schematic diagram on a spring-clamp capo in the present art.
Figure 3:
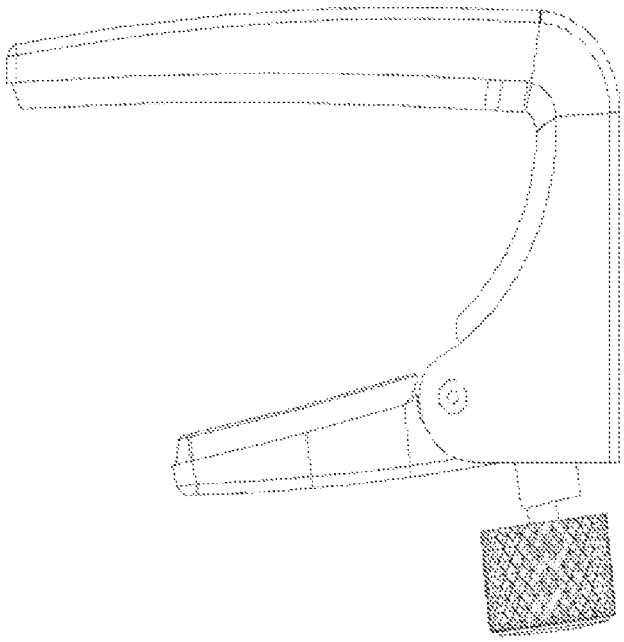
FIG. 3 illustrates a schematic diagram on a screw-on capo in the present art.
Figure 4:
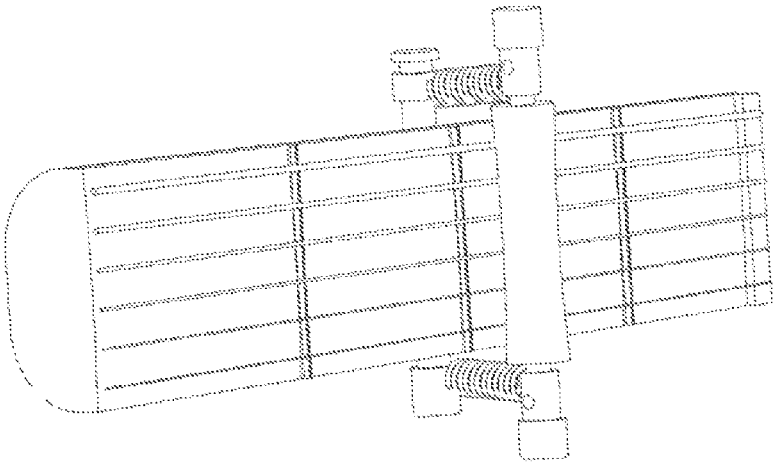
FIG. 4 illustrates a schematic diagram on a rolling capo in the present art.
Figure 5:
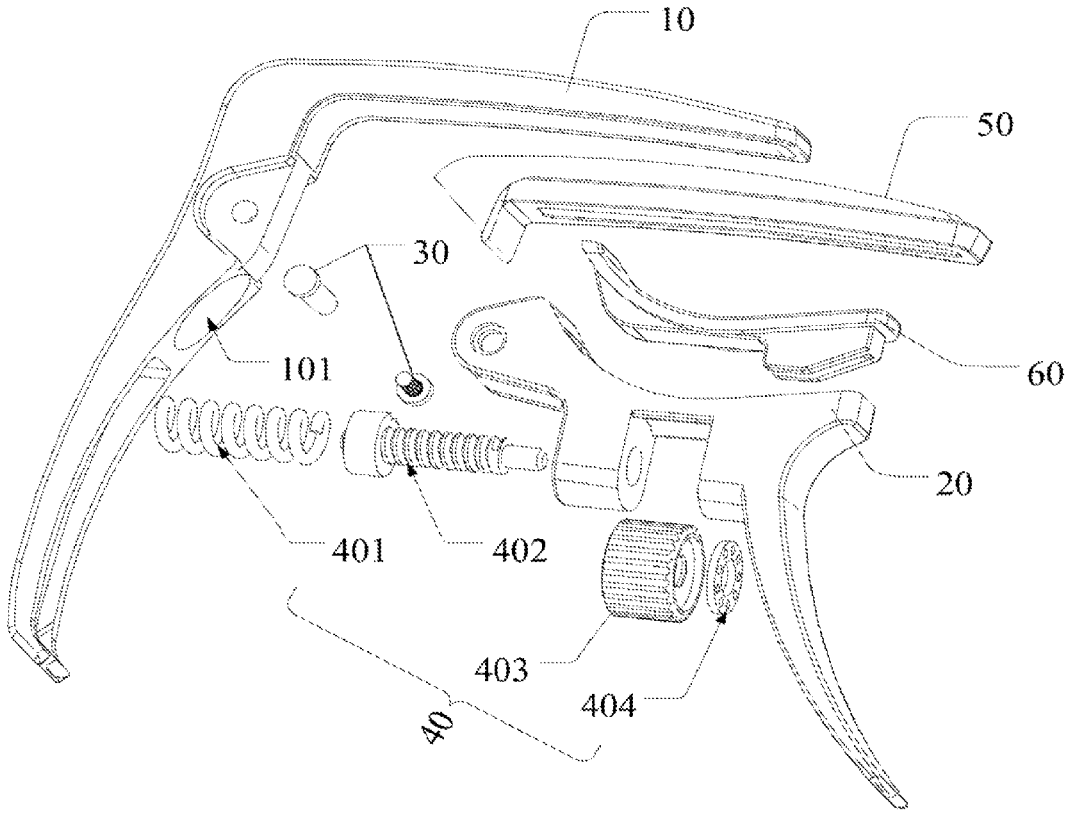
FIG. 5 illustrates an explored view of a force adjustable spring-clamp capo as provided in the present utility model.

The present utility model provides a force adjustable spring-clamp capo, whose clamping force may be adjusted according to a requirement of a player, which is easy to operate, quickly and effort saving.

In order to make the purpose, technical solution and the advantages of the present utility model clearer and more explicit, further detailed descriptions of the present utility model are stated here, referencing to the attached drawings and some embodiments of the present utility model. It should be understood that the detailed embodiments of the utility model described here are used to explain the present utility model only, instead of limiting the present utility model.

Referencing to FIG. 5, FIG. 6, FIG. 7 and FIG. 8, the force adjustable spring-clamp capo provided in the present utility model, comprises a string-engaging arm 10 and a clamping arm 20, the string-engaging arm 10 and the clamping arm 20 are hinged together by a composite pressing rivet 30, a pressure adjustment mechanism 40 is further arranged in a middle of the clamping arm 20, which includes: a pressure spring 401, a regulation screw 402 and a regulation nut 403, the clamping arm 20 further has a screw adjustment through hole 201, a nut accommodating port 205 applied to accommodating the regulation nut 403, and a screw limiting hole 206 arranged; one end of the pressure spring 401 locates in a spring accommodating hole 101 in the string-engaging arm 10, while another end of the pressure spring 401 reaches one end of the regulation screw 402, another end of the regulation screw 402 passes through the screw regulating through hole 201 and screws with the regulation nut 403 in the nut accommodating port 205, before inserting into the screw limiting hole 206. Through turning the regulation nut 403, it may make the regulation screw 402 extend or retract from the screw limiting hole 206, to achieve a purpose of compressing or extending the pressure spring 401, so as to make the capo reach a purpose of the clamping force adjustable.

Further, a planar thrust bearing 404 is embedded in the regulation nut 403, one end face of the planar thrust bearing 404 touches the clamping arm 20, there is a contact face between the regulation nut 403 and the clamping arm 20, during a process of turning the regulation nut 403, a frictional resistance may be generated, which in turn effects a feel of an adjustment, through the planar thrust bearing 404, it may greatly reduce the resistance generated by a friction between the regulation nut 403 and the clamping arm 20, before simplifying an operation of adjusting a force, which achieves a purpose of effort saving, and makes a player a better usage experience.

Figure 6:
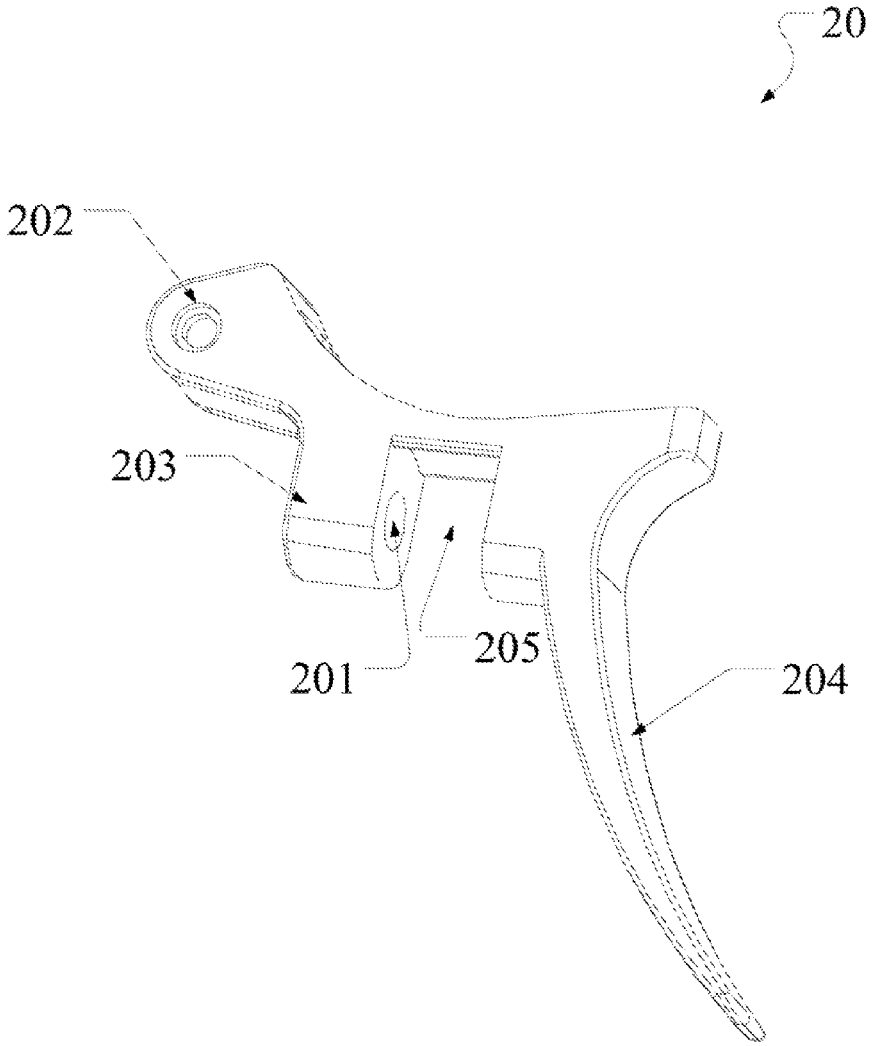
FIG. 6 illustrates a schematic diagram on a clamping arm of a force adjustable spring-clamp capo as provided in the present utility model.

As shown in FIG. 6, the clamping arm 20 includes: a hinge portion 202, a pressure regulation portion 203 and a handhold portion 204arranged sequentially; the hinge portion 202 is a two-piece portion, wherein the string-engaging arm 10 is sandwiched between the two-piece portion, and hinged by the composite pressing rivet 30; the screw regulating through hole 201 is arranged on the pressure regulation portion 203, between the pressure regulation portion 203 and the handhold portion 204, there is the nut accommodating port 205 arranged, a width of the nut accommodating port 205 is slightly larger than a length of the regulation nut 403, making the regulation nut 403 have a certain space for turning forward and backward, the screw limiting hole 206 is arranged on the handhold portion 204, one end of the regulation screw 402 is placing in the screw regulating through hole 201, while another end of the regulation screw 402 is placing in the screw limiting hole 206.

The hinge portion 202, the pressure regulation portion 203 and the handhold portion 204 are integrated into one piece, saving a cost while improving a stress resistance of a product at a same time.

Figure 7:
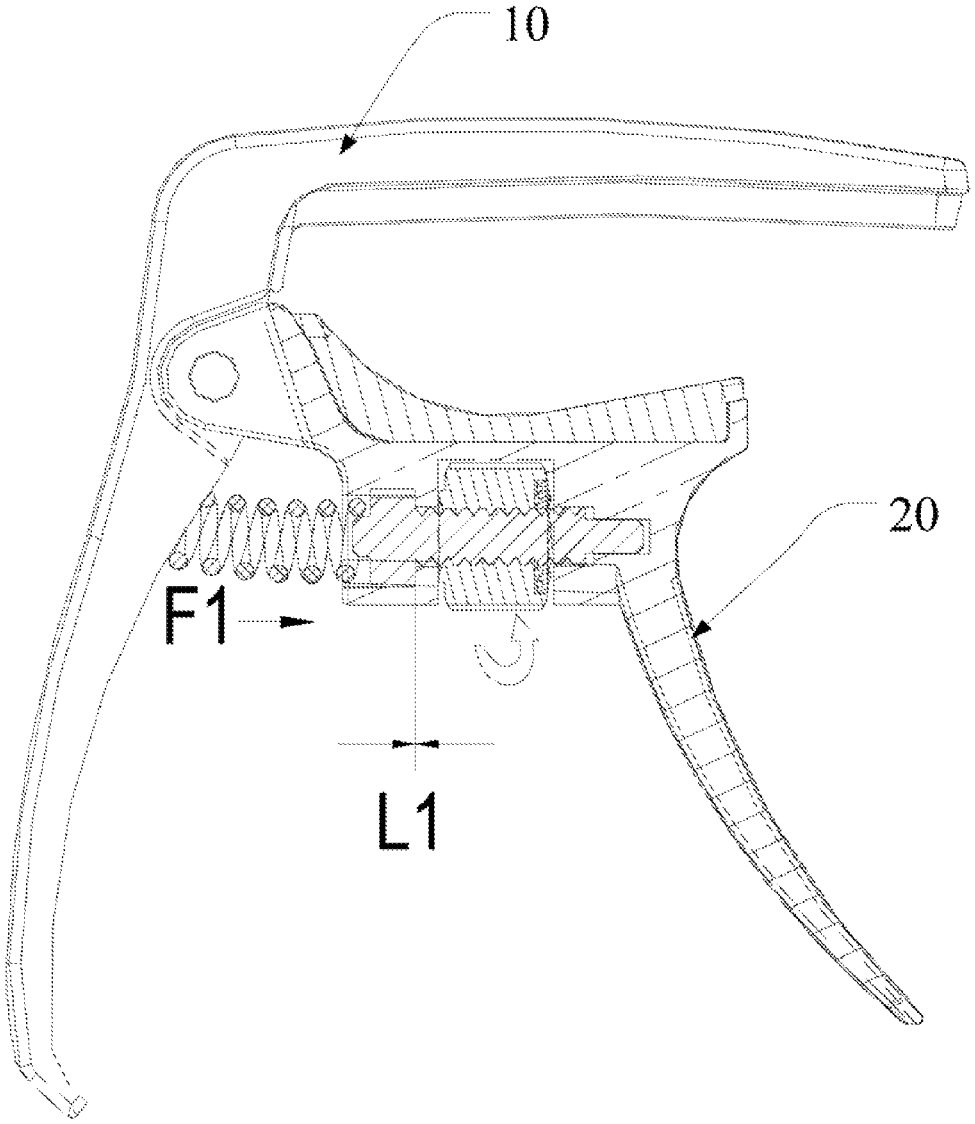
FIG. 7 illustrates a schematic diagram on a pressure spring in an initial state of a force adjustable spring-clamp capo as provided in the present utility model.
Figure 8:
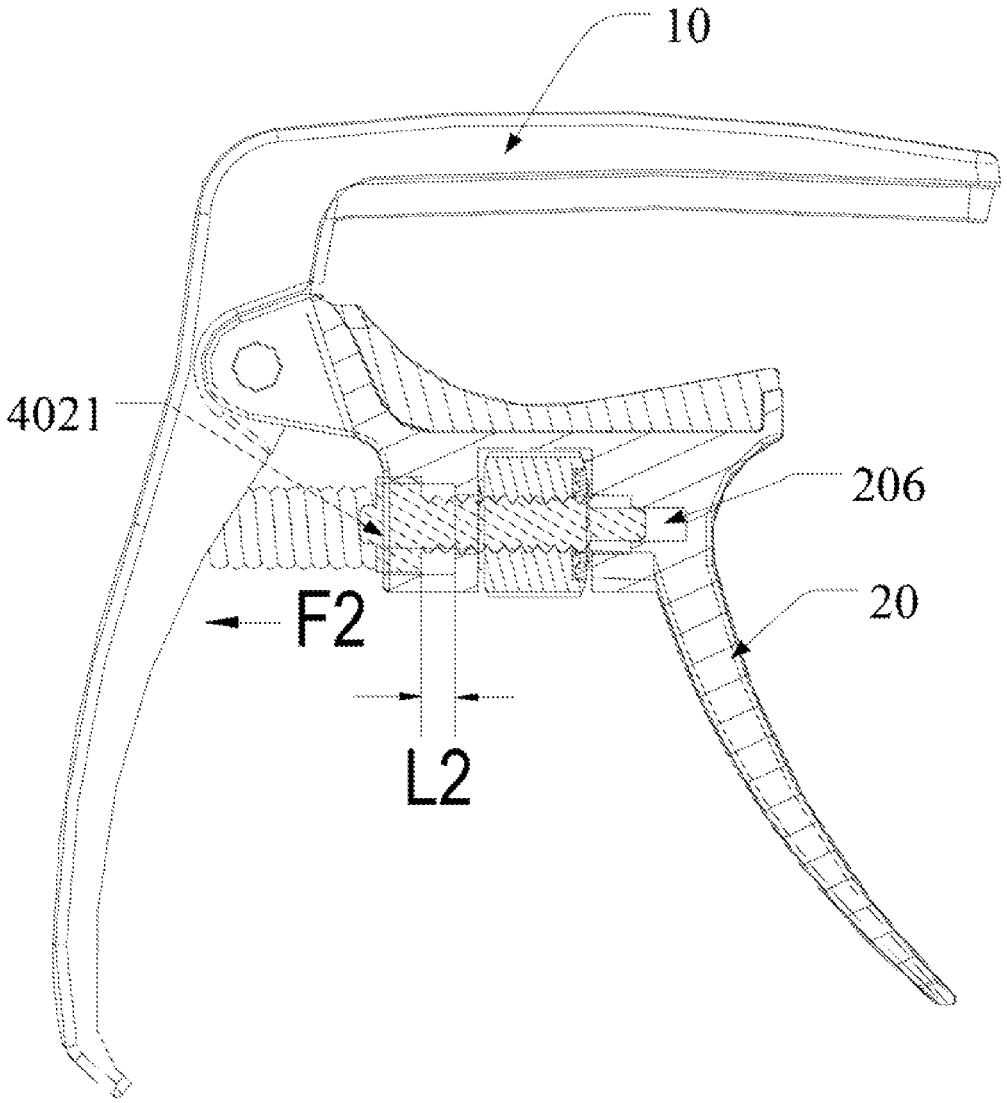
FIG. 8 illustrates a schematic diagram on a pressure spring in a compressed state of a force adjustable spring-clamp capo as provided in the present utility model.

Referencing to FIG. 7 and FIG. 8 together, the screw regulating through hole 201 is T-shaped, a nut on a front end of the regulation screw 402 is placed in the screw regulating through hole 201, a rod portion of the regulation screw 402 passes through the screw regulating through hole 201, while the screw regulating through hole 201 further makes a limiting action, determining a maximum extension length of the pressure spring 401, and further preventing the regulation screw 402 sliding out through the screw adjusting through hole 201.

Further, the screw limiting hole is also a T-shape, an end of the screw has a limiting portion without any threads, whose diameter is smaller than that of a thread part of the screw, to avoid the end of the screw shaking, when adjusting the screw. A sum of three openings of the screw adjusting through hole, the nut accommodating port and the screw limiting hole is larger than the length of the screw, making the screw a certain space for adjustment during an extending or retreating adjustment.

A middle portion of the string-engaging arm 10 hinges with the hinge portion 202 of the clamping arm 20, making the clamping arm 20 open or close according to the string-engaging arm 10.

An end face of the regulation screw 402 has a raised portion 4021 to prevent the pressure spring 401 sliding, the pressure spring 401 is fitted over the raised portion 4021, when the pressure spring 401 is taking a force, the raised portion 4021 makes the pressure spring 401 no deformation and popping out when taking a pressure.

Specifically, the regulation nut 403 has a non-slip pattern arranged on the regulation nut 403, to increase a friction force between a hand and the regulation nut 403, in order to achieve a purpose of preventing slipping, being convenient for the player to operate.

Further, an inner surface of the string-engaging arm 10 has a first cushion 50 arranged, which acts as a non-slip action, with an instrument protection action, protecting the instrument from being pinched or scratched.

A second cushion 60 is arranged on an inner surface of the clamping arm 20, which acts as a non-slip action, with an instrument protection action, protecting the instrument from being pinched or scratched. Specifically, the first cushion 50 and the second cushion 60 is preferred to be made of a plurality of elastic materials including but not limited to rubber and silicon rubber.

A structural principle of the force adjustable spring-clamp capo is: the force adjustable spring-clamp capo adds a pressure adjustment mechanism 40 being able to adjust the force, on basis of a structure of the spring-clamp capo.

As shown in FIG. 7, which is an initial state of a spring, wherein the pressure spring 401 is at a state of a minimum compression, with a spring force of F1. Another end of the regulation screw 402 is locating at an initial position of a bottom of the screw limiting hole 206 in the clamping arm 20, with a distance L1 apart from the bottom of the screw limiting hole 206 in the clamping arm 20.

When it is needed to adjust the clamping force of the capo, turning the regulation nut 403, and leading the regulation screw 402 extending or retracting, as shown in FIG. 8, which is an elasticity adjustment state: the pressure spring 401 is at a compressed state, having a spring force of F2, changing a compression length of the pressure spring 401, to make a spring force of the pressure spring 401 change, turning the regulation nut 403 makes the regulation screw 402 extend (screw out) a distance of L2, which is also an extension value of the pressure spring 401. According to Hooke's law: when a spring is making an elastic deformation, a spring force F of the spring is proportional to an extension (or compression) of the spring. The spring in the capo is compressed and having a larger spring force, that makes the clamping force of the capo increase.

All above, the force adjustable spring-clamp capo provided by the present utility model, owns an advantage of a simple operation and a stable flexibility as a spring-clamp capo, together with a character of force adjustable as a screw-on capo. By the pressure adjustment mechanism in the assembly structure, the collapsing length of the pressure spring is adjusted, making the force of the spring change (Hooke's law), which makes the clamping force of the capo adjustable, it can also be operated by a single hand of the player as the spring-clamp capo, thus owns a simple and easy operation, making the player be able to adjust to a best clamping force according to a requirement of the instrument thereof, to achieve a role of a tune transfer assistance perfectly. By a planar thrust bearing embedded in the regulation nut, the present utility model further reduces the resistance generated by the friction between the regulation nut and the clamping arm greatly, thus simplifies the operation of a force adjustment, and achieves the purpose of effort saving.

It should be understood that, the application of the present utility model is not limited to the above examples listed. It will be possible for a person skilled in the art to make modification or replacements according to the above descriptions, which shall all fall within the scope of protection in the appended claims of the present application.

What is claimed is:

1. A force adjustable spring-clamp capo, comprises a string-engaging arm and a clamping arm, the string-engaging arm and the clamping arm are hinged together by a composite pressing rivet, wherein a pressure adjustment mechanism is arranged in a middle of the clamping arm, including: a pressure spring, a regulation screw and a regulation nut, while the clamping arm has a screw adjustment through hole, a nut accommodating port applied to accommodating the regulation nut, and a screw limiting hole arranged; one end of the pressure spring locates in a spring accommodating hole in the string-engaging arm, another end of the pressure spring reaches one end of the regulation screw, another end of the regulation screw passes through the screw adjustment through hole and screws with the regulation nut in the nut accommodating port, before inserting into the screw limiting hole.

2. The force adjustable spring-clamp capo according to claim 1, wherein a planar thrust bearing is embedded in the regulation nut, one end face of the planar thrust bearing touches the clamping arm.

3. The force adjustable spring-clamp capo according to claim 1, wherein the clamping arm comprises: a hinge portion, a pressure regulation portion and a handhold portion arranged sequentially; the hinge portion is a two-piece portion, the string-engaging arm is sandwiched between the two-piece portion, and hinged by the composite pressing rivet; the screw regulating through hole is arranged on the pressure regulation portion, the nut accommodating port is arranged between the pressure regulation portion and the handhold portion, the screw limiting hole is arranged on the handhold portion.

4. The force adjustable spring-clamp capo according to claim 3, wherein the hinge portion, the pressure regulation portion and the handhold portion are integrated into one piece.

5. The force adjustable spring-clamp capo according to claim 3, wherein the screw regulating through hole is T-shaped.

6. The force adjustable spring-clamp capo according to claim 1, wherein a middle portion of the string-engaging arm hinges with the hinge portion of the clamping arm.

7. The force adjustable spring-clamp capo according to claim 1, wherein an end face of the regulation screw has a raised portion, applied to preventing the pressure spring sliding.

8. The force adjustable spring-clamp capo according to claim 1, wherein a non-slip pattern is arranged on the regulation nut.

9. The force adjustable spring-clamp capo according to claim 1, wherein a first cushion is arranged on an inner surface of the string-engaging arm.

10. The force adjustable spring-clamp capo according to claim 1, wherein a second cushion is arranged on an inner surface of the clamping arm.

11. The force adjustable spring-clamp capo according to claim 3, wherein a middle portion of the string-engaging arm hinges with the hinge portion of the clamping arm.

* * * * *